US005777432A

United States Patent [19]

Xie

[11] Patent Number: 5,777,432

[45] Date of Patent: Jul. 7, 1998

[54] HIGH BREAKDOWN FIELD EMISSION DEVICE WITH TAPERED CYLINDRICAL SPACERS

[75] Inventor: Chenggang Xie, Phoenix, Ariz.

[73] Assignee: Motorola Inc., Schaumburg, Ill.

[21] Appl. No.: 838,494

[22] Filed: Apr. 7, 1997

[51] Int. Cl.[6] ..... H01J 1/62

[52] U.S. Cl. ..... 313/495; 313/310; 313/311; 313/351

[58] Field of Search ..... 313/310, 311, 313/331, 351, 356, 495

[56] References Cited

U.S. PATENT DOCUMENTS

| | | | |
|---|---|---|---|
| 5,015,912 | 5/1991 | Spindt et al. | 313/495 |
| 5,063,327 | 11/1991 | Brodie et al. | 313/482 |
| 5,349,217 | 9/1994 | Boysel | 257/266 |
| 5,374,868 | 12/1994 | Tjaden et al. | 313/310 |
| 5,545,946 | 8/1996 | Wiemann et al. | 313/497 |
| 5,548,181 | 8/1996 | Jones | 313/309 |
| 5,559,389 | 9/1996 | Spindt et al. | 313/310 |
| 5,561,343 | 10/1996 | Lowe | 313/482 |
| 5,598,056 | 1/1997 | Jin et al. | 313/495 |
| 5,621,272 | 4/1997 | Levine et al. | 313/422 |
| 5,633,650 | 5/1997 | Kishino et al. | 345/74 |
| 5,691,600 | 11/1997 | Moyer et al. | 313/497 |

OTHER PUBLICATIONS

"Workshop on Transient Induced Insulator Flashover in Vacuum" Sponsored by Microwave and Pused Power Thrust Area, Lawrence Livermore National Laboratory, Aug. 24–25, 1988.

"Prebreakdown Conduction Measurements in Vacuum Gaps with Alumina Insulators" by R. Lee, T.S. Sudarshan, J.E. Thompson, and G.R. Nagabhushana, IEEE, pp. 103–107, 1982.

*Primary Examiner*—Sandra L. O'Shea
*Assistant Examiner*—Matthew J. Gerike
*Attorney, Agent, or Firm*—Jasper W. Dockrey; Kathleen A. Tobin

[57] ABSTRACT

A field emission device (100) includes a supporting substrate (110) having a major surface; a cathode (111) disposed on the major surface of the supporting substrate (110); a dielectric layer (112) disposed on the cathode (111); a gate extraction electrode (114) disposed on the dielectric layer (112); the cathode (111), the dielectric layer (112), and the gate extraction electrode (114) defining a spacer well (132); an anode plate (104) opposing the gate extraction electrode (114); a spacer (106) extending between the cathode (111) at the spacer well (132) and the anode plate (104); a first spacer shield (108) disposed within the spacer well (132) and surrounding the spacer (106); and a second spacer shield (108) affixed to the anode plate (104) and surrounding the spacer (106).

20 Claims, 2 Drawing Sheets

100

200

300

400

HIGH BREAKDOWN FIELD EMISSION DEVICE WITH TAPERED CYLINDRICAL SPACERS

FIELD OF THE INVENTION

The present invention pertains to the area of field emission devices and, more particularly, to structural spacers for field emission devices.

BACKGROUND OF THE INVENTION

Structural spacers for flat panel devices, such as field emission displays, are known in the art. In one prior art field emission display, glass spheres or glass ribs are placed between the cathode and anode plates of the display. Typically these prior art field emission displays are operated at relatively low electric field strengths, below about 2 volts/μm, without causing voltage breakdown of the spacers.

It is desired in the art to develop a flat panel field emission display that operates at much higher voltages, within a range of about 3000–5000 volts, and higher. Simultaneously, it is desired that the gap between the cathode and anode plates be very small, on the order of a millimeter. A configuration including high operating voltage and small inter-plate gap results in the formation of high electric fields. In prior art field emission displays, these high electric fields result in voltage breakdown along the surface of glass spacers. The voltage breakdown results in the conduction of current between the cathode and anode plates, effectively ruining the display. The breakdown field of prior art spacers is typically below about 2 V/μm. It is desired to increase this breakdown field strength.

In the prior art, the voltage breakdown of spacers has been prevented by reducing the voltage between the cathode and anode plates and/or increasing the distance between the plates. However, these prior art solutions provide field emission displays that have low brightness and exhibit color mixing.

It is generally agreed upon by those in the art that the voltage breakdown of an insulator in a vacuum environment is initiated at an insulator/vacuum/electrode triple junction. While the bulk insulator material has a breakdown strength within a range of about 100–200 V/μm, the vacuum breakdown of the insulating surface is much lower than 100 V/μm. The breakdown of the insulating surface is believed to be caused by a greatly enhanced local electric field at the triple junction. The electric field enhancement is believed to be due to defects, such as small voids, present in the interface between the insulator and the metal. The enhanced local electric field initiates the emission of electrons at the triple junction. These electrons then usually multiply as they traverse the insulator surface, either as a surface secondary electron emission avalanche or as an electron cascade in a thin surface layer. The enhanced emission causes the desorption of gas molecules absorbed on the insulator surface. This desorbed gas is then ionized, which can lead to surface flashover of the insulator.

Accordingly, there exists a need for an improved structural spacer for a field emission device having improved breakdown characteristics.

Figure 1:
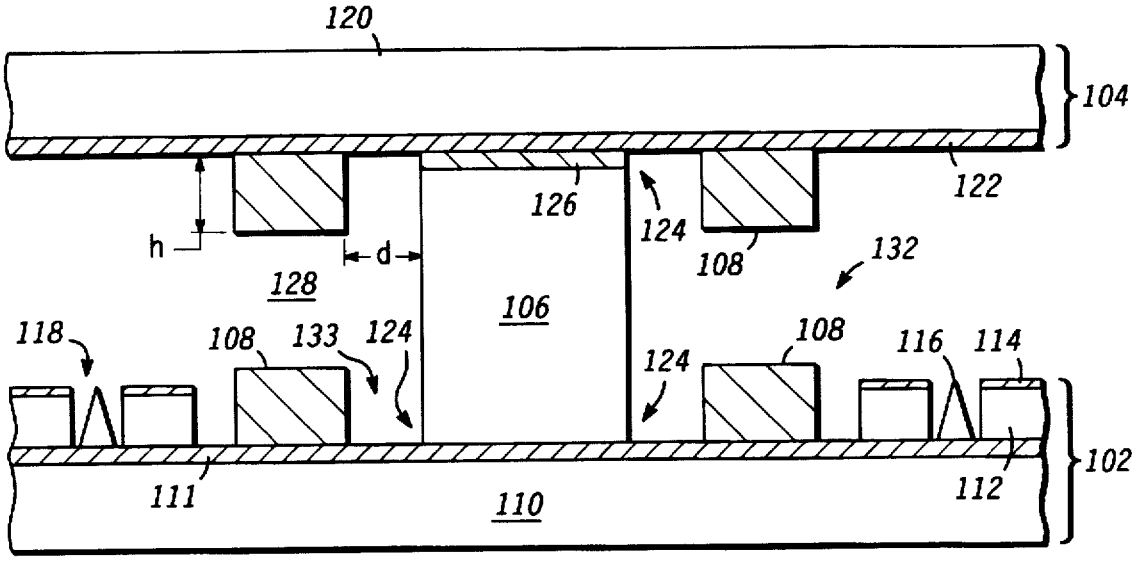
FIG. 1 is a cross-sectional view of a first embodiment of a field emission device in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a high breakdown field field emission device having a high breakdown field spacer. The invention allows for the use of higher operating voltages and smaller cathode-to-anode plate distance by shielding the insulator/vacuum/electrode triple junction. A shield reduces the local field enhancement at the triple junction. The shield includes a metallic structure that surrounds the spacer and is proximate to the triple junction. A field emission display in accordance with the invention can operate at high voltages, within a range of 3000–5000 volts, and has a small cathode-to-anode plate distance, which is less than or equal to about 1 millimeter. This configuration provides improved brightness and improved color purity of the display.

FIG. 1 illustrates, in cross-section, a field emission device 100 in accordance with the invention. Field emission device 100 includes a cathode plate 102, an anode plate 104, a spacer 106, and a plurality of spacer shields 108.

Cathode plate 102 includes a supporting substrate 110. A cathode 111 is formed on supporting substrate 110 by a convenient deposition technique, such as PECVD, evaporation, and the like. Cathode plate 102 further includes a dielectric layer 112, which is formed on cathode 111. A gate extraction electrode 114 is formed on dielectric layer 112. Formed in dielectric layer 112 and gate extraction electrode 114 are a plurality of emission wells 118. An emissive structure 116 is formed in each of emission wells 118. In the embodiment of FIG. 1 emissive structures 116 include Spindt tips. Field emission device 100 may include electron emissive structures other than Spindt tips, such as edge emitters, surface emitters, and the like.

Many types of materials can be used to fabricate the foregoing structures. For example, supporting substrate 110 can be a hard dielectric material, such as silicon, glass, and the like. Further, cathode 111 includes a layer of a conductive material, such as aluminum, molybdenum, and the like. Dielectric layer 112 is made from a dielectric material, such as silicon dioxide, silicon nitride, and the like. Gate extraction electrode 114 includes a conductive material, such as molybdenum, aluminum, and the like, which is deposited by a convenient deposition technique. Emissive structures 116 are made from a field emissive material, such as molybdenum, silicon, and the like Spacer 106 includes a dielectric member, such as a glass rod, glass rib, and the like, which has opposed ends. One of the opposed ends of spacer 106 is affixed to anode plate 104; the other opposed end rests on cathode 111. Anode plate 104, includes an anode 122, which includes a layer of metal, such as aluminum, nickel, and the like. Anode 122 is formed on a supporting substrate 120, which includes a hard dielectric material, such as glass, silicon, and the like. To affix spacer 106 to anode 122, a layer 126 of a bonding metal, such as gold, nickel, and the like, is provided at the opposed end of spacer 106 that is to be affixed. Layer 126 is applied to spacer 106 by electroplating and is then bonded to anode 122 by a convenient bonding process, such as thermal compression bonding, ultrasonic bonding, and the like.

Surrounding each of the opposed ends of spacer 106 is one of spacer shields 108. In the embodiment of FIG. 1, spacer 106 includes a cylindrical rod, and each of spacer shields 108 includes a ring that surrounds spacer 106. Spacer shields 108 do not physically touch spacer 106. Spacer shields 108 are made from a metal, such as nickel, copper, aluminum, and the like. Spacer shields 108 are affixed to anode 122 and cathode 111 by a convenient bonding method, such as thermal compression bonding, ultrasonic bonding, and the like. Spacer shields 108 can also be fabricated using well known microfabrication technologies, including deposition methods, such as electroplating, evaporation, sputtering, and the like, and patterning methods.

The operation of field emission device 100 includes holding cathode 111 at ground potential, applying a positive voltage to gate extraction electrode 114 of about 80 volts, and applying a higher voltage at anode 122, which may be in the range of about 3000–5000 volts. This voltage configuration is predetermined to effect electron emission from emissive structures 116. An interspace region 128 between cathode plate 102 and anode plate 104 is evacuated to a pressure less than about $1\times10^{-5}$Torr.

A plurality of triple junctions 124 exist within field emission device 100. Each of triple junctions 124 is defined by one of either anode 122 or cathode 111, spacer 106, and the vacuum within interspace region 128. In accordance with the invention, the local, enhanced electric field at triple junctions 124 is reduced by shielding triple junctions 124 from the electric field. In the embodiment of FIG. 1, spacer shields 108 provide the shielding of triple junctions 124 from the electric field. Spacer shield 108, which is affixed to anode 122, deters anode-initiated surface flashover; spacer shield 108, which is affixed to cathode 111, deters cathode-initiated surface flashover.

Preferably, the distance, d, between spacer shield 108 and spacer 106 is less than or equal to the height, h, of spacer shield 108. For example, the height, h, may be 10 μm and the distance, d, may be within a range of 1–10 μm.

The breakdown electric field strength of spacer 106 is within a range of about 10–20 V/pm, which is 2–10 times higher than that of the prior art. Thus, for a given anode voltage, the height of spacer 106 can be reduced over that of prior art spacers. This reduces the spacer's aspect ratio, which is the ratio of spacer height to spacer width/diameter. A smaller aspect ratio improves the mechanical integrity of the spacer. Reduced spacer height also reduces the distance over which emitted electrons travel and, therefore, reduces the extent of fanning/spreading of the beam. In this manner, smaller electron spot sizes are achieved at anode 122.

Field emission device 100 can be made by first forming cathode 111, emissive structures 116, and gate extraction electrode 114, by using convenient deposition and etching methods. After the formation of emissive structures 116, a region between addressable portions of gate extraction electrode 114 is etched to form a spacer well 132 and expose a portion of cathode 111. For each spacer 106, one of spacer shields 108 is affixed to cathode 111 and another of spacer shields 108 is affixed to anode 122. Spacer 106 is affixed to anode 122. Thereafter, anode plate 104 is aligned with cathode plate 102, such that the unaffixed edge of spacer 106 is aligned with a central aperture 133 of spacer shield 108. This unaffixed end is then placed upon cathode 111, preferably centered within central aperture 133 of spacer shield 108.

Figure 2:
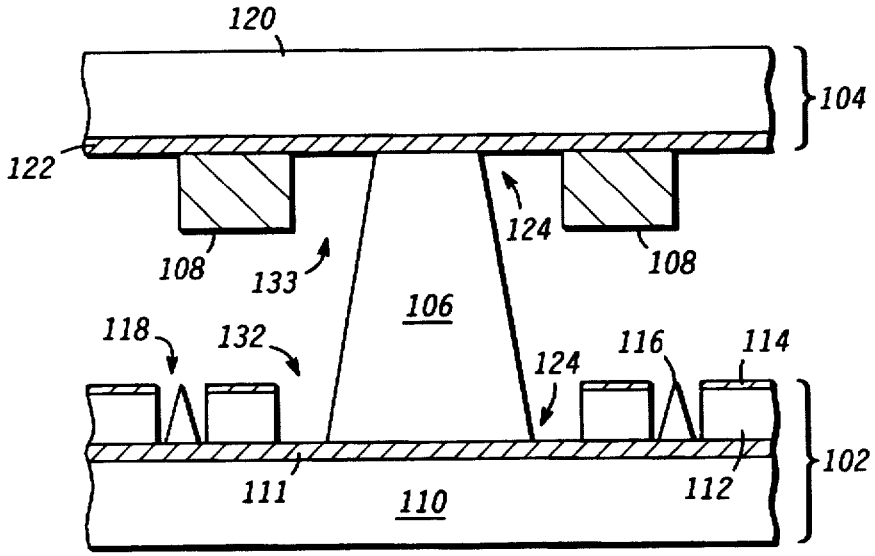
FIG. 2 is a cross-sectional view of a second embodiment of a field emission device in accordance with the invention.

FIG. 2 illustrates, in cross-section, a field emission device 200, in accordance with the invention. The embodiment of FIG. 2 includes spacer shield 108 on anode 122, as described with reference to FIG. 1. Spacer shield 108 shields triple junctions 124 at anode 122. No spacer shield 108 is provided within spacer well 132. Rather, the shielding of triple junctions 124 at cathode 111 is provided by gate extraction electrode 114.

Dielectric layer 112 has a thickness on the order of 1 μm. Thus, the gap between gate extraction electrode 114 and spacer 106 is also about 1 μm. Gate extraction electrode 114 includes a layer of a metal, such as molybdenum, niobium, and the like, and has a thickness of about 3000 angstroms.

Spacer 106 can be affixed to anode 122, in the manner described with reference to FIG. 1, or it can be similarly affixed to cathode 111. Alternatively, a binder can be used to bond spacer 106 to one of cathode 111 or anode 122.

In the embodiment of FIG. 2, spacer 106 is formed on cathode 111 subsequent to the formation of emissive structures 116. This microfabrication method includes, first, pouring polyamic acid onto cathode plate 102 and spinning cathode plate 102 concurrently. After the polyamic acid is deposited, the coated cathode is baked in an oven at 100° C. to remove organic solvents. A mask defining the spacer configuration is provided on the baked coated cathode. The masked coating is exposed and developed. The developed portions are removed by rinsing with a convenient rinsing solution, such that spacers 106 remain. After removing the developed portions of the coating, the cathode/spacer structure is baked in a vacuum oven to outgas adsorbed contaminants. The details of this microfabrication method for forming spacers are described in U.S. Pat No. 5,063,327, entitled "Field Emission Cathode Based Flat Panel Display Having Polyimide Spacers", by Brodie et al, issued on Nov. 5, 1991.

This microfabrication process forms spacers 106 that are tapered. The tapered geometry further improves the breakdown characteristics of spacers 106. The voltage breakdown of a tapered geometry occurs at a higher field strength than that of a cylindrical geometry.

After spacers 106 are formed, cathode and anode plates 102, 104 are brought into alignment, such that the unaffixed edge of spacer 106 is positioned in central aperture 133 of spacer shield 108 and placed onto anode 122. Spacer 106 does not physically contact spacer shield 108.

Figure 3:
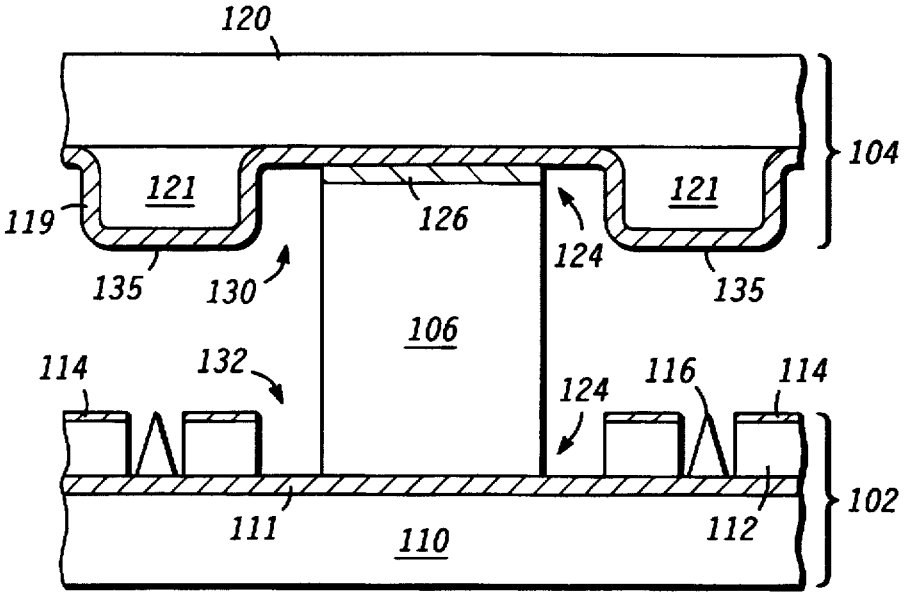
FIG. 3 is a cross-sectional view of a first embodiment of a field emission display in accordance with the invention.

FIG. 3 illustrates, in cross-section, a field emission display 300 in accordance with the invention. Anode plate 104 of field emission display 300 includes a plurality of cathodoluminescent deposits 121, which are affixed to substrate 120, which is made from a hard transparent material, such as glass, plastic, and the like. Each of cathodoluminescent deposits 121 has a thickness within a range of about 5–10 μm.

A conductive layer 119 is formed on cathodoluminescent deposits 121. Conductive layer 119 is made from a metal, such as aluminum, nickel, and the like, and has a thickness of about 2000 angstroms. A depression 130 is defined by adjacent ones of cathodoluminescent deposits 121. The distance between adjacent ones of cathodoluminescent deposits 121 is about 100 μm. Conductive layer 119 defines a plurality of shielding lands 135.

Spacers 106 have a diameter less than or equal to about 80 μm. One of the edges of spacer 106 is placed within depression 130 and is affixed to conductive layer 119 by a convenient bonding method, such as thermal compression bonding, ultrasonic bonding, and the like. For conductive layer 119 being made of aluminum, layer 126 may include a layer of gold.

In general, depression 130 are within a range of about 10–20 μm wider than spacer 106. Spacer 106 is preferably centered within depression 130. Shielding lands 135 do not physically contact spacer 106. Shielding lands 135 shield triple junctions 124 at anode plate 104 from the electric field. The anode potential is also applied to layer 119. The shielding of triple junctions 124 at cathode plate 102 is similar to that described with reference to FIG. 2.

After spacer 106 is affixed to conductive layer 119, anode plate 104 is aligned with cathode plate 102, such that the unaffixed edge of spacer 106 is placed within spacer well 132. Spacer well 132 is defined by cathode 111, dielectric layer 112, between addressable portions of gate extraction electrode 114. Spacer well 132 is formed in a manner similar to that described with reference to FIG. 1. The unaffixed edge of spacer 106 is placed in physical contact with the exposed portion of cathode 111. Alternatively, spacer 106 can be formed using microfabrication methods, such as described with reference to FIG. 2.

Figure 4:
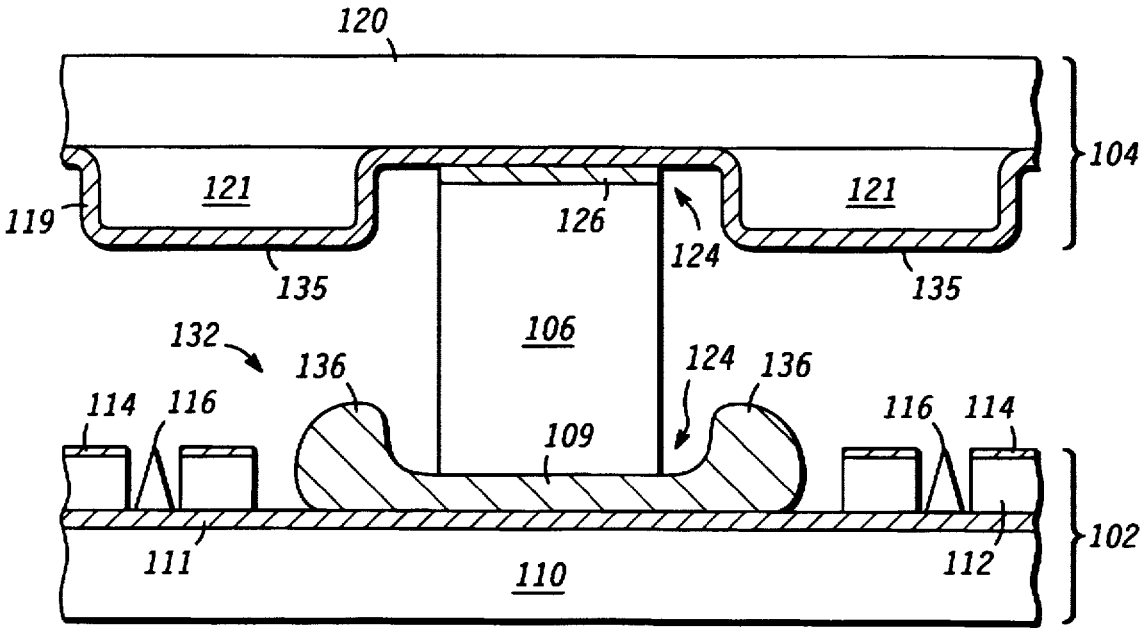
FIG. 4 is a cross-sectional view of a second embodiment of a field emission display in accordance with the invention.

FIG. 4 illustrates, in cross-section, a field emission display 400 in accordance with the invention. Field emission display 400 contains the elements of field emission display 300 of FIG. 3, and further includes a metal pad 109. Metal pad 109 is disposed on the exposed portion of cathode 111, within spacer well 132. Metal pad 109 has a raised portion 136, which is spaced from and surrounds spacer 106. Raised portion 136 provides the field shielding of triple junctions 124 at cathode plate 102. This shielding significantly reduces the breakdown field by reducing the local field enhancement at the triple junctions defined by metal pad 109, spacer 106, and the vacuum.

Metal pad 109 is formed by depositing a ball of a soft metal, such as gold, nickel, and the like, on cathode 111 at spacer well 132. The metal ball may be deposited using a wire bonding machine. After the metal ball is formed, the anode plate/spacer structure is aligned with cathode plate 102, such that the unaffixed edge of spacer 106 is in abutting engagement with the metal ball. Pressure is applied to cathode and anode plates 102, 104, so that spacer 106 is pressed into the metal ball.

Metal pad 109 also provides compliance to accommodate for variations in the height of spacers 106. This compliance reduces the risk of breakage of some of spacers 106 due to uneven load distribution over spacers 106.

In summary, a high breakdown field field emission device in accordance with the invention includes a spacer and spacer shield, which increases the breakdown field strength of the spacer. The invention allows for a smaller distance between the cathode and anode plates of the device. This improves the spot size of the electron beams at the anode plate, which improves the resolution of the device. The invention also allows the operation of the device at voltages that are higher than those of the prior art. Higher operating voltages in a field emission display of the invention improve the luminance, efficiency, and spot size.

While I have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

I claim:

1. A field emission device (100, 200) comprising:

a cathode plate (102);

an anode plate (104) opposing the cathode plate (102);

a spacer (106) extending between the cathode plate (102) and the anode plate (104); and a spacer shield (108) surrounding the spacer (106).

2. The field emission device (100, 200) as claimed in claim 1, wherein the spacer shield (108) comprises a metal ring.

3. The field emission device as claimed in claim 1, wherein the spacer (106) has an edge, and wherein the spacer shield comprises a metal pad (109) having a raised portion (136), the metal pad (109) being affixed to the cathode plate (102), the edge of the spacer (106) being in abutting engagement with the metal pad (109), the raised portion (136) of the metal pad (109) being spaced from and surrounding the spacer (106).

4. The field emission device (100, 200) as claimed in claim 1, wherein the spacer shield (108) has a distance from the spacer (106) and a height, and wherein the distance from the spacer (106) is within a range of 0.1–1 times the height of the spacer shield (108).

5. The field emission device (200) as claimed in claim 1, wherein the spacer (106) is tapered.

6. A field emission device (100, 200) comprising:

a cathode plate (102);

an anode plate (104) opposing the cathode plate (102) to define an interspace (128) region therebetween;

a spacer (106) extending between the cathode plate (102) and the anode plate (104);

the spacer (106), the cathode plate (102) and the interspace region (128) defining a triple junction (124); and a spacer shield (108) surrounding the spacer (106) proximate to the triple junction (124).

7. The field emission device (100, 200) as claimed in claim 6, wherein the spacer shield (108) comprises a metal ring.

8. The field emission device (100, 200) as claimed in claim 6, wherein the spacer shield (108) has a distance from the spacer (106) and a height, and wherein the distance from the spacer (106) is within a range of 0.1–1 times the height of the spacer shield (108).

9. The field emission device (200) as claimed in claim 6, wherein the spacer (106) is tapered.

10. A field emission device (100, 200) comprising:

a supporting substrate (110) having a major surface;

a cathode (111) disposed on the major surface of the supporting substrate (110);

a dielectric layer (112) disposed on the cathode (111);

a gate extraction electrode (114) disposed on the dielectric layer (112);

the cathode (111), the dielectric layer (112), and the gate extraction electrode (114) defining a spacer well (132);

an anode plate (104) opposing the gate extraction electrode (114); and a spacer (106) extending between the cathode (111) at the spacer well (132) and the anode plate (104) and being spaced from the gate extraction electrode (114).

11. The field emission device (100) as claimed in claim 10, further comprising a spacer shield (108) disposed within the spacer well (132) and surrounding the spacer (106).

12. The field emission device (100) as claimed in claim 11, wherein the spacer shield (108) has a distance from the spacer (106) and a height, and wherein the distance from the spacer (106) is within a range of 0.1–1 times the height of the spacer shield (108).

13. The field emission device (200) as claimed in claim 10, wherein the dielectric layer (112) has a thickness, and wherein the distance between the spacer (106) and the gate extraction electrode (114) is within a range of 0.1–1 times the thickness of the dielectric layer (112).

14. The field emission device (100, 200) as claimed in claim 10, further comprising a spacer shield (108) affixed to the anode plate (104) and surrounding the spacer (106).

15. The field emission device (100, 200) as claimed in claim 14, wherein the spacer shield (108) has a distance from the spacer (106) and a height, and wherein the distance from the spacer (106) is within a range of 0.1–1 times the height of the spacer shield (108).

16. The field emission device (200) as claimed in claim 10, wherein the spacer (106) is tapered.

17. The field emission device as claimed in claim 10, wherein the spacer (106) has an edge, and further including a metal pad (109) having a raised portion (136), the metal pad (109) being affixed to the cathode (111) at the spacer well (132), the edge of the spacer (106) being in abutting engagement with the metal pad (109), such that the raised portion (136) of the metal pad (109) are spaced from and surrounds the spacer (106).

18. A field emission display (300, 400) comprising:

a cathode plate (102);

an anode plate (104) opposing the cathode plate (102) and having a plurality of cathodoluminescent deposits (121), the plurality of cathodoluminescent deposits (121) defining a depression (130);

a conductive layer (119) being disposed on the plurality of cathodoluminescent deposits (121) to define a plurality of shielding lands (135); and a spacer (106) having first and second opposed edges and extending between the cathode plate (102) and the anode plate (104), the first opposed edge being disposed within the depression (130) and being in abutting engagement with the anode plate (104), the shielding lands (135) being spaced from the spacer (106), the second opposed edge being in abutting engagement with the cathode plate (102).

19. The field emission display (300, 400) as claimed in claim 18, wherein the depression (130) has a depth, and wherein the distance between each of the plurality of shielding lands (135) and the spacer (106) is within a range of 0.1–1 times the depth of the depression (130).

20. The field emission display as claimed in claim 18, wherein the spacer is tapered.

* * * * *